US006173131B1

(12) United States Patent
Kitamura et al.

(10) Patent No.: US 6,173,131 B1
(45) Date of Patent: Jan. 9, 2001

(54) IMAGE HEATING APPARATUS

(75) Inventors: Shingo Kitamura, Odawara; Nobuyuki Watanabe; Junichi Noguchi, both of Yokohama, all of (JP)

(73) Assignee: Canon Kabushiki Kaisha, Tokyo (JP)

( * ) Notice: Under 35 U.S.C. 154(b), the term of this patent shall be extended for 0 days.

(21) Appl. No.: 08/993,157

(22) Filed: Dec. 18, 1997

(30) Foreign Application Priority Data

Dec. 19, 1996 (JP) ..... 8-354562

(51) Int. Cl.[7] ..... G03G 15/20

(52) U.S. Cl. ..... 399/33; 374/153; 374/183; 399/69

(58) Field of Search ..... 399/33, 69, 70, 399/328, 330, 335; 219/216, 469, 470, 471; 323/369; 374/153, 183, 185

(56) References Cited

U.S. PATENT DOCUMENTS 3,316,765 * 5/1967 Trolander et al. ..... 374/172
3,652,921 * 3/1972 Ny ..... 323/369
4,001,545 * 1/1977 Wada et al. ..... 219/216
4,367,037 * 1/1983 Nishikawa ..... 399/69
5,019,693 * 5/1991 Tamary ..... 399/33
5,325,164 * 6/1994 Tai et al. ..... 219/216
5,572,306 * 11/1996 Goto et al. ..... 99/69
5,633,704 * 5/1997 Suzuki et al. ..... 399/69
5,663,899 * 9/1997 Zvonar et al. ..... 374/179
5,735,604 * 4/1998 Ewals et al. ..... 399/69
5,862,436 * 1/1999 Ishizawa et al. ..... 399/69

* cited by examiner

*Primary Examiner*—William J. Royer
(74) *Attorney, Agent, or Firm*—Fitzpatrick, Cella, Harper & Scinto

(57) ABSTRACT

An image heating apparatus includes a heating member for heating an image on a recording material, a first temperature detecting element for detecting a first temperature of the heating member, a second temperature detecting element for detecting the second temperature of the heating member, wherein a thermal property of the second temperature detecting element differs from a thermal property of the first temperature detecting element, and a power supply controller for controlling the power supply to the heating member by utilizing the first temperature detecting element and the second temperature detecting element.

4 Claims, 17 Drawing Sheets

FIG. 3A

| TEMPERATURE (℃) | THERMISTOR FOR HIGH TEMPERATURE | | THERMISTOR FOR LOW TEMPERATURE | |
|---|---|---|---|---|
| | RESISTANCE VALUE $R_{TH}$ (kΩ) | DETECTED VOLTAGE (V) 101 USING $R_1$ EQUAL TO 10K Ω | RESISTANCE VALUE $R_{TH}$ (kΩ) | DETECTED VOLTAGE (V) 101 USING $R_1$ EQUAL TO 10K Ω |
| −50 | 527954.64 | 5.000 | 1160.10 | 4.957 |
| −25 | 55079.41 | 4.999 | 121.03 | 4.618 |
| −1 | 9298.37 | 4.995 | 20.43 | 3.357 |
| 1 | 8130.81 | 4.994 | 17.83 | 3.206 |
| 25 | 1870.13 | 4.973 | 4.11 | 1.456 |
| 50 | 510.36 | 4.904 | 1.12 | 0.504 |
| 100 | 64.08 | 4.325 | 0.14 | 0.069 |
| 150 | 13.14 | 2.839 | 0.03 | 0.014 |
| 200 | 3.77 | 1.368 | 0.01 | 0.004 |

FIG. 12A 1401 1402

| TEMPERATURE (℃) | DIVISION RESISTANCE VALUE SYNTHETIC RESISTANCE OF R1 AND R2=10KΩ | | DIVISION RESISTANCE VALUE R1=100MΩ | |
|---|---|---|---|---|
| | RESISTANCE VALUE $R_{TH}$ (kΩ) | DIVISION VOLTAGE ave (V) | RESISTANCE VALUE $R_{TH}$ (kΩ) | DIVISION VOLTAGE ave (V) |
| −50 | 527954.64 | 5.000 | 527954.64 | 4.907 |
| −25 | 55079.41 | 4.999 | 55079.41 | 4.232 |
| −1 | 9298.37 | 4.995 | 9298.37 | 2.409 |
| 1 | 8130.81 | 4.994 | 8130.81 | 2.242 |
| 25 | 1870.13 | 4.973 | 1870.13 | 0.788 |
| 50 | 510.36 | 4.904 | 510.36 | 0.243 |
| 100 | 64.08 | 4.326 | 64.08 | 0.032 |
| 150 | 13.14 | 2.840 | 13.14 | 0.007 |
| 200 | 3.77 | 1.369 | 3.77 | 0.002 |

IMAGE HEATING APPARATUS

BACKGROUND OF THE INVENTION

1. Field of the Invention

The present invention relates to an image heating apparatus used in an image forming apparatus such as a copying machine, a printer and the like.

2. Related Background Art

In the past, a thermal fixing means including a heat roller was mainly used to fix a toner image developed in an image forming portion and transferred to a recording sheet to the recording sheet as a permanent image. In general, a fixing roller including a heater therein is urged against a pressure roller to form a fixing nip therebetween. A toner image is thermally fixed to the recording sheet by heat from the heater while the recording sheet is being passed through a nip between the fixing roller and the pressure roller.

Control of temperature of the heat roller is effected by a temperature sensor such as a thermistor contacted with the rotating heat roller. In the present day, the temperature control of the heat roller has been effected by using a CPU (central processing unit) in control of almost of all copying machines.

In the temperature control effected by the CPU, a heat amount given to the heat roller by the CPU is controlled by converting voltage (corresponding to a temperature of the heat roller) from the temperature sensor into a digital amount by means of an A/D (analogue/digital) converter.

[Explanation of Construction of Conventional Fixing Device]

FIG. 4 shows a conventional fixing device.

Here, explanation is made regarding an example of a fixing device in which an upper heat fixing roller and a lower pressure roller are urged against each other to form a fixing nip where a toner image (developed at an image forming portion and transferred to a recording sheet) is fixed to the recording sheet as a permanent image.

In FIG. 4, a fixing roller 40*a* contacted with the toner image has an outer diameter of 60 mm and is constituted by an aluminium core cylinder 418, an HVT (high temperature vulcanizing type) silicone rubber layer 417 having a thickness of 1 mm and coated on the core cylinder, and a special adding type silicone rubber layer 416 coated on the rubber layer 417.

On the other hand, the pressure roller 40*b* has an outer diameter of 60 mm and is constituted by an aluminium core cylinder 412, an HVT silicone rubber layer having a thickness of 1 mm and coated on the core cylinder, and a special adding type silicone rubber layer 415 having a thickness of 1 mm and coated on the silicone rubber layer.

In the fixing roller 40*a,* a convey roller heater (heat generating means) 409 is disposed within the core cylinder 418, and, in the pressure roller 40*b,* a heater 413 is disposed within the core cylinder 412, so that the recording sheet is heated from both sides. A temperature of the fixing roller 40*a* is detected by a thermistor 410 contacted with the fixing roller 40*a* and a temperature of the pressure roller 40*b* is detected by a thermistor 411 contacted with the pressure roller 40*b*. The halogen heaters 409, 413 are controlled by a control device 414 on the basis of detected temperatures so that the temperature of the fixing roller 40*a* is maintained to 170° C. (constant) and the temperature of the pressure roller 40*b* is maintained to 165° C. (constant). The fixing roller 40*a* and the pressure roller 40*b* are urged against each other with total pressure of 80 kg by means of a pressurizing mechanism (not shown). In FIG. 4, symbol 0 denotes an oil applying device (mold releasing agent applying device); C denotes a cleaning device; and C1 denotes a cleaning blade for removing oil and contamination from the pressure roller 40*b*. In the oil applying device 0, dimethyl silicone oil 408 in an oil pan 407 is picked up by oil pick-up rollers 406 and 405 and is applied to the fixing roller 40*a* by an oil applying roller 404 while regulating an oil applying amount by means of an oil applying amount regulating blade 403. In the cleaning device C, the surface of the fixing roller 40*a* is cleaned by a web 402 contacted with the fixing roller 40*a* by an abut roller 401. In the above-mentioned fixing device, the recording sheet on which a non-fixed toner image was borne is conveyed to the fixing nip (between the fixing roller 40*a* and the pressure roller 40*b*), where the recording sheet is heated and pressurized from both sides, thereby fixing the toner image onto the recording sheet. In this case, toners adhered to the fixing roller 40*a* and the pressure roller 40*b* are removed by the cleaning device C and the cleaning blade C1, respectively.

However, when the temperature of the heat roller detected by a single thermistor with high accuracy is unreliable, due to temperature errors in a series of conversion circuits from the thermistor to the CPU and temperature properties of the thermistor, if a low temperature reading accuracy of a thermistor selected for high temperature detecting is worsened, the low temperature cannot be measured accurately by the thermistor selected for the high temperature. Thus, when the surface temperature of the roller is heated to a desired temperature, due to poor abutment of a thermistor for low temperature and/or breakage of a signal line of the thermistor, it is difficult to quickly detect an abnormality of increase in temperature of the heat roller.

[Explanation of Causes for Worsening Low Temperature Reading Accuracy of Thermistor for High Temperature]

FIG. 1 shows a typical temperature detection circuit using a thermistor. In FIG. 1, the reference numeral 107 denotes a thermistor; 103, 104 and 106 denote fixed resistances; 105 denotes a circuit resistance component such as current limitter resistance; 102 denotes an OP amplifier; and 101 denotes detected voltage corresponding to detection temperature of the thermistor 107.

When reference resistance value is $R_0$ and temperature is $T_0$, a resistance value $R_{th}$ of the thermistor is represented by the following equation (1):

$$R_{th}=R_0\times\exp B\{(1/T)-(1/T_0)\} \quad (1)$$

where, B is a thermistor B constant (K) and T is an absolute temperature.

Further, when the above equation (1) is converted with respect to T, the following equation can be obtained:

$$T=(T_0\times B)/(T_0\times\{\mathrm{Ln}\ R-\mathrm{Ln}\ R_0\}+B) \quad (2)$$

The above equation (2) can be rewritten as follows:

$$1/T=(1/T_0)+\{(\mathrm{Ln}\ R_{th}/(B\times\mathrm{Ln}\ R_0)\} \quad (3)$$

When $T_0$, $R_0$ and B are regarded as constants, and $\alpha=1/T_0$ and $\beta=B\times\mathrm{Ln}\ R_0$, the following equations are obtained:

$$1/T=\alpha+(\mathrm{Ln}\ R_{th}/\beta) \quad (4)$$

$$T=1/\{(\alpha\times\mathrm{Ln}\ R_{th})+\beta\} \quad (5)$$

Thus, a reciprocal of natural logarithm of the resistance error of the thermistor in the circuit appears as an error of the reading temperature. Since the resistance value of the thermistor for high temperature is increased in an exponential function manner as the temperature is decreased, the error factor of the resistance value regarding the temperature is also increased. This is one error factor of the reading temperature.

Regarding the detected voltage 101, voltage obtained by dividing power source voltage (Vcc) by a resistance value ($R_1$) of the division resistance 106 and the resistance value ($R_{th}$) of the thermistor 107 is outputted, and is represented by the following relation:

$$\text{Detected voltage } \mathbf{101} \text{ (out)} = \{R_{th}/(R_1+R_{th})\} \times Vcc \quad (6)$$

FIG. 2A is a graph showing a relation between the measured temperature of the thermistor and the detected voltage, which represents a relation between the detected voltage 101 in the circuit shown in FIG. 1 and the temperature detected by the thermistor. In FIG. 2A, the abscissa indicates the detection temperature value of the thermistor and the ordinate indicates the detected voltage value.

The fixing device in electrophotography is normally used under a temperature of about 150° C. In order to improve the accuracy of the detected voltage 101 regarding the reading temperature in an area c in FIG. 2A (temperature of about 150° C.), the reference resistance value ($R_0$) and temperature ($T_0$) of the thermistor and the division resistance value $R_1$ for generating the detected voltage 101 are determined.

Consequently, as seen by referring to curve 211, a change of the detected voltage as a function of a change of the temperature of the heat roller is greater outside the range d. However, in the case where the temperature of the heat roller is within the range d, the change of the detected voltage to the change of the temperature is small, thereby the temperature cannot be detected precisely.

Thus, conventionally, it was difficult to quickly find the abnormality of the fixing device, particularly abnormality regarding poor attachment of the thermistor and/or breakage of the signal line of the thermistor.

For example, it is assumed that the thermistor is not properly contacted with the fixing roller and is spaced apart from the fixing roller. If the temperature detecting accuracy of the thermistor is high under not only a high temperature but also under a low temperature, by measuring the degree of the temperature increase during the energization time period, it can be judged in a short time from the start of energization whether any abnormality exists (i.e., whether or not the thermistor is contacted with the roller). However, if the temperature detecting accuracy of the thermistor is inadequate for a low temperature, even if the temperature increases during the energization time period, reliability of the measured value is poor, and, thus, it is difficult to judge whether an abnormality exists.

In this way, if the abnormal condition such as the poor attachment (in which the thermistor is not contacted with the fixing roller) and/or breakage of the signal line of the thermistor has occurred, it is difficult to find the abnormal condition until the temperature of the fixing roller is increased up to the temperature area where the temperature detecting accuracy of the thermistor becomes high.

SUMMARY OF THE INVENTION

The present invention aims to eliminate the above-mentioned conventional drawbacks, and an object of the present invention is to provide an image heating apparatus which can quickly detect an abnormality such as poor attachment of a thermistor and breakage of a signal line of the thermistor.

To achieve the above object, according to the present invention, there is provided an image heating apparatus comprising a heating member for heating an image on a recording material, a first temperature detecting element for detecting a first temperature of the heating member, a second temperature detecting element for detecting a second temperature of the heating member, thermal property of the second temperature detecting element differing from thermal property of the first temperature detecting element, and an energization control means for controlling energization of the heating member by utilizing the first temperature detecting element and the second temperature detecting element.

The other objects of the present invention will be apparent from the following detailed explanation of the invention.

BRIEF DESCRIPTION OF THE DRAWINGS

FIG. 3A is a Table showing a relation between temperatures of the thermistors of the heat fixing apparatus according to the first embodiment and division voltage values.

FIG. 12A is a Table showing a relation between measured temperatures and division voltage values obtained by switching the division resistance in the heat fixing apparatus according to the second embodiment.

DETAILED DESCRIPTION OF PREFERRED EMBODIMENTS

The present invention will now be explained in connection with embodiments thereof with reference to the accompanying drawings. However, dimensions, materials, configurations and relative positional relations of constructural elements shown in the embodiments do not limit the present invention so long as special limitation is not given.

Figure 13:
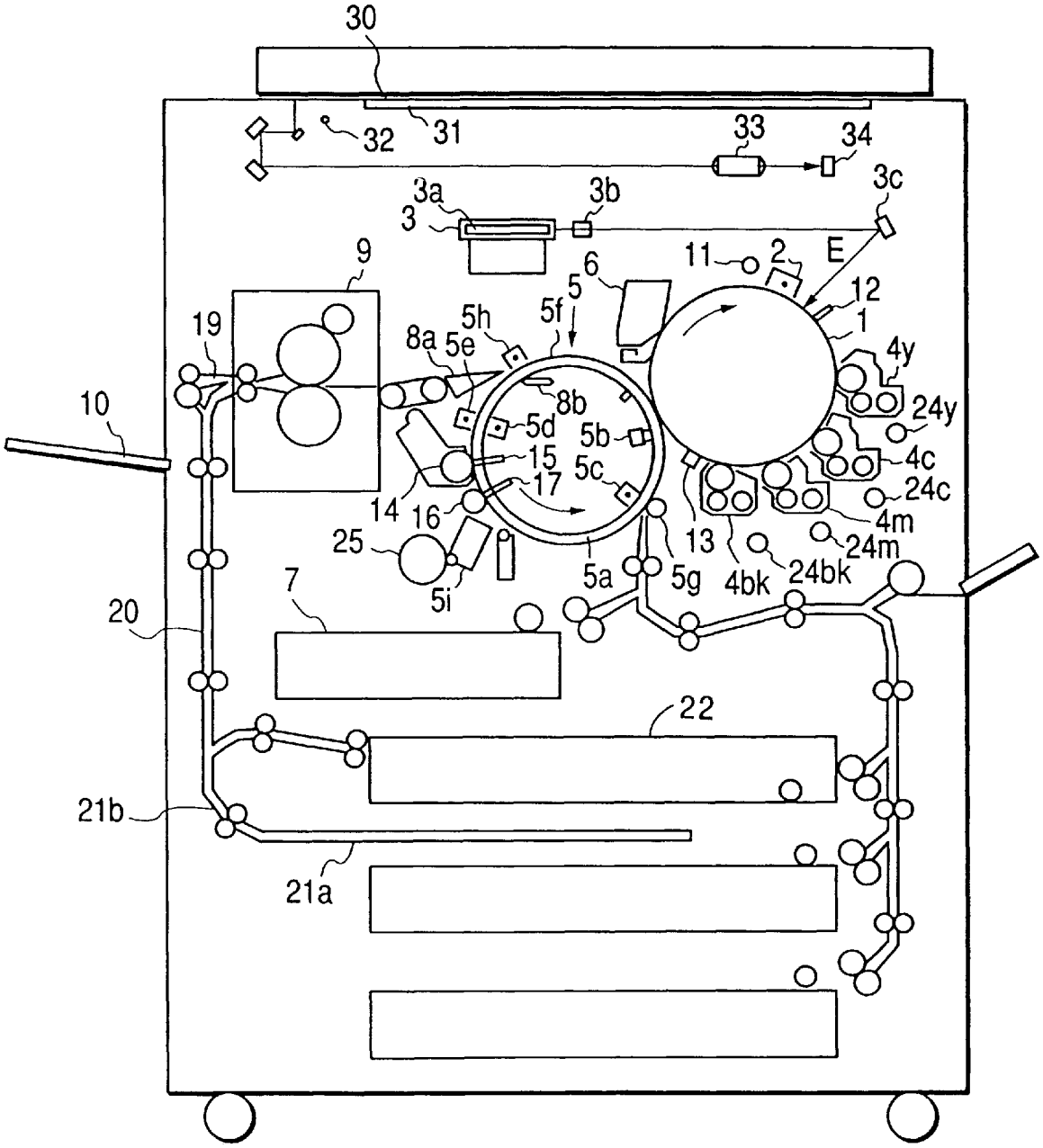
FIG. 13 is a schematic view of a color copying machine to which the heat fixing apparatus according to the present invention can be applied.

FIG. 13 is a schematic sectional view of a color image forming apparatus to which a heat fixing apparatus according to the present invention can be applied.

The image forming apparatus includes an upper digital color image reader portion and a lower digital color image printer portion.

In the reader portion, after an original 30 is rested on an original glass support 31, by exposure-scanning the original by an exposure lamp 32, an image reflected from the original is focused on a full-color sensor 34 through a lens 33, thereby obtaining color decomposed image signals. The color decomposed image signals are sent, through an amplifier circuit (not shown), to a video process unit (not shown), where the signals are treated. Then, the signals are sent to the printer portion.

In the printer portion, a photosensitive drum (image bearing member) 1 is supported for rotation in a direction shown by the arrow. Around the photosensitive drum 1, there are disposed a pre-exposure lamp 11, a corona charger 2, a laser exposure optical system 3, a potential sensor 12, four developing devices 4*y*, 4*c*, 4*m*, 4*Bk* including different color toners, a drum light amount detecting means 13, a transfer device 5 and a cleaning device 6.

In the laser exposure optical system 3, the image signal from the reader portion is converted into a light signal in a laser output portion (not shown), and the converted laser beam is reflected by a polygon mirror 3*a* and is projected onto a surface of the photosensitive drum 1 through a lens 3*b* and a mirror 3*c*.

During image formation in the printer portion, the photosensitive drum 1 is rotated in the direction shown by the arrow, and, electricity is removed from the photosensitive drum by the pre-exposure lamp 11, the photosensitive drum 1 is uniformly charged by the charger 2. Then, for each decomposed color, a light image E is illuminated on the photosensitive drum, thereby forming a latent image.

Then, a selected developing device is operated to develop the latent image on the photosensitive drum 1, thereby forming a toner image based on resin on the photosensitive drum 1. The developing devices can selectively be approached to the photosensitive drum 1 for each decomposed color by driving eccentric cam 24*y*, 24*c*, 24*m* or 24*Bk*.

The toner image on the photosensitive drum 1 is transferred, by the transfer device 5, onto a recording material supplied to a transfer position (where the transfer device is opposed to the photosensitive drum 1) from a recording material cassette 7 through a convey system. In the illustrated embodiment, the transfer device 5 includes a transfer drum 5*a*, a transfer charger 5*b*, an absorb charger 5*c* and an opposed absorb roller 5*g* for electrostatically absorbing the recording material, an inner charger 5*d* and an outer charger 5*e*, and a dielectric recording material bearing sheet 5*f* is mounted in a cylindrical form to a peripheral opening zone of the transfer drum 5*a* supported for rotation. A dielectric sheet such as polycarbonate film is used as the recording material bearing sheet 5*f*.

As the drum-shaped transfer material (i.e., transfer drum 5*a*) is rotated, the toner image on the photosensitive drum 1 is transferred, by the transfer charger 5*b*, onto the recording material born on the recording material bearing sheet 5*f*.

A desired number of color toner images are transferred to the recording material born on the recording material bearing sheet 5*f* in this way to form a full-color image.

In the full-color image formation, after four color toner images were transferred, the recording material is separated from the transfer drum 5*a* by a separation pawl 8*a*, a separation push-up roller 8*b* and a separation charger 5*h*. Then, the recording sheet is passed through a heat roller fixing device 9 and then is discharged onto a tray 10.

After the transferring, residual toner remaining on the photosensitive drum 1 is removed by the cleaning device 6 for the preparing for next image formation.

When images are formed on both surfaces of the recording material, after the recording material is discharged from the fixing device 9, a convey path switching guide 19 is driven immediately, so that the recording material is temporarily introduced into a reverse path 21*a* through a convey vertical path 20. Then, by rotating a reverse roller 21*b* reversely, the recording material is returned to a return direction opposite to an introduction direction with a trail end of the recording material facing the return direction, thereby resting on an intermediate tray 22. Thereafter, the image is formed on the other surface of the recording material in the same image forming process as mentioned above.

In order to remove powder adhered to the recording material bearing sheet 5*f* of the transfer drum 5*a* and to prevent oil from adhering to the recording material, the recording material bearing sheet 5*f* is cleaned by a fur brush 14 and a back-up brush 15 opposed to the fur brush 14 with the interposition of the recording material bearing sheet 5*f*, and, an oil removing roller 16 and back-up brush 17 opposed to the roller 16 with the interposition of the recording material bearing sheet 5*f*. Such cleaning is effected before or after the image formation and is always effected whenever a sheet jam occurs.

In the illustrated embodiment, by operating a cam follower 5*i* integral with the transfer drum 5*a* by driving an eccentric cam 25 at a desired timing, a gap between the recording material bearing sheet 5*f* and the photosensitive drum, can be selected appropriately. For example, in a stand-by condition or in a power OFF condition, the transfer drum is separated from the photosensitive drum.

(First Embodiment)

In a heat fixing apparatus according to a first embodiment of the present invention, as a temperature detecting means for achieving high accurate temperature reading until a surface temperature of a fixing device is changed from low temperature to high temperature, a combination of a thermistor for low temperature and a thermistor for high temperature is used.

Figure 1:
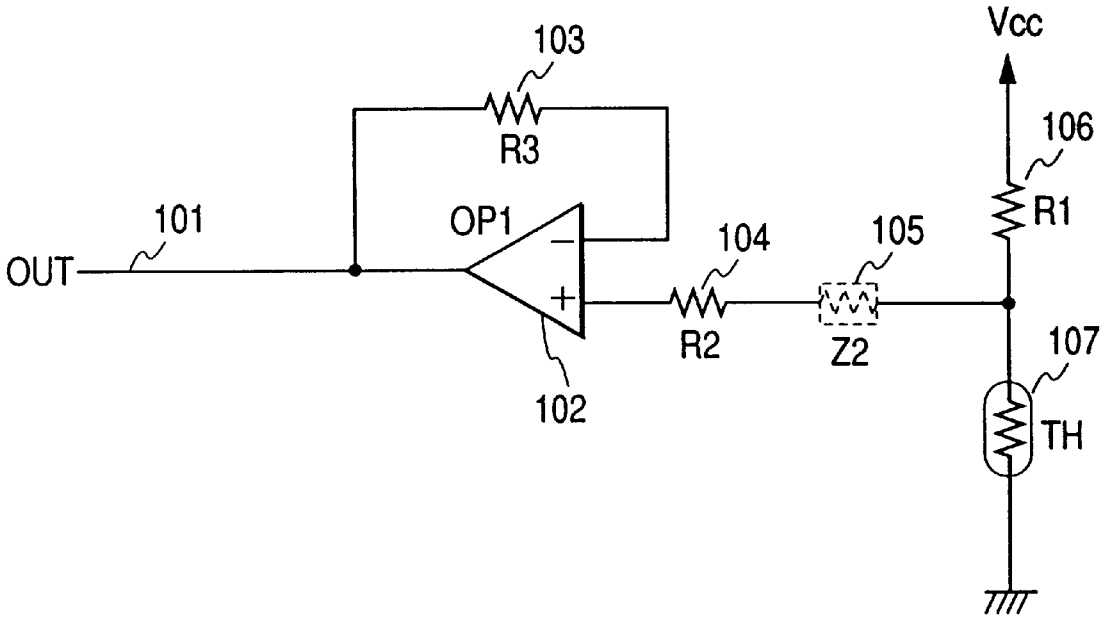
FIG. 1 PRIOR ART
FIG. 1 is a view showing a conventional temperature detecting circuit using a thermistor.
Figure 2A:
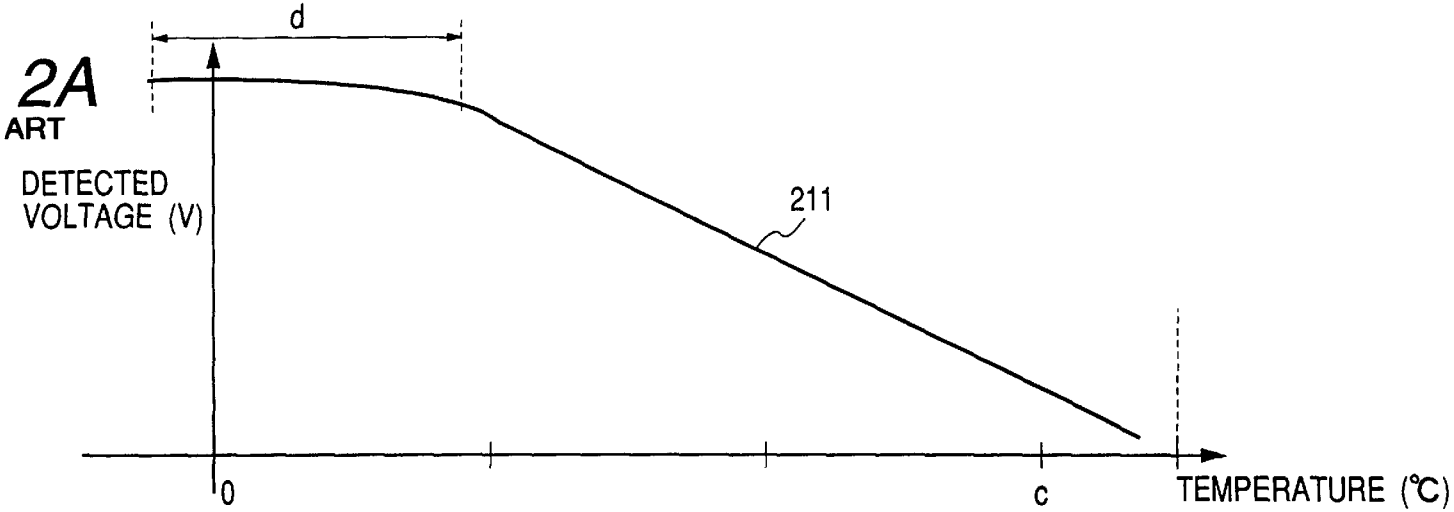
FIG. 2A PRIOR ART
FIG. 2A is a graph showing a relation between a temperature measured by the conventional thermistor and detected voltage.
Figure 2B:
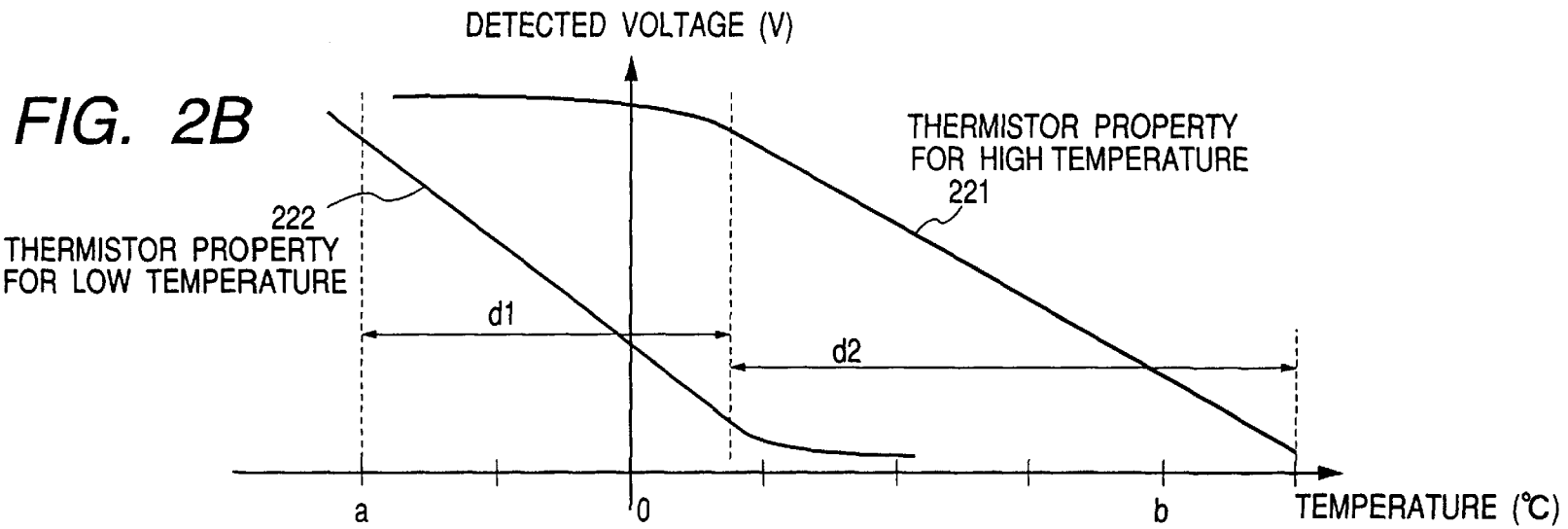
FIG. 2B is a graph showing a relation between a measured temperature and detected voltage by using a combination of a thermistor for low temperature and a thermistor for high temperature of a heat fixing apparatus according to a first embodiment of the present invention.

FIG. 2B shows a relation between a measured temperature and detected voltage obtained by using the combination of the thermistor for low temperature and the thermistor for high temperature. In FIG. 2B, the abscissa indicates a temperature value detected by the thermistors and the ordinate indicates a detected voltage value. A curve 221 represents-detected voltage property of the thermistor for high temperature and a curve 222 represents detected voltage property of the thermistor for low temperature.

By reading the surface temperature of the fixing device by combining a range dl where the detected voltage property of the thermistor for low temperature is linear and a range d2 where the detected voltage property of the thermistor for high temperature is linear, the thermistors can be used within the range having small temperature error, thereby increasing the resolving power of the detected voltage at the low temperature area.

By using the combination of the thermistor for low temperature and the thermistor for high temperature in this way, it is possible to provide a detecting apparatus which can achieve high accurate temperature reading within a wide temperature range (a to b).

Tests were carried out by using a thermistor having a measurement range of −25° C. to 70° C. as the thermistor for low temperature and a thermistor having a measurement range of 70° C. to 250° C. as the thermistor for high temperature. It was found that, in FIG. 2B, "a" becomes −50° C. and "b" becomes 150° C., and, thus, high accurate temperature reading can be effected within a wide range.

FIG. 3A is a Table showing an example of division voltages values vs thermistor temperatures. The Table indicates a relation between the temperatures measured by the thermistor for low temperature and the thermistor for high temperature, and resistance values of the thermistors and division voltage values when resistance of 10 kΩ is used as the division resistance.

Figure 3B:
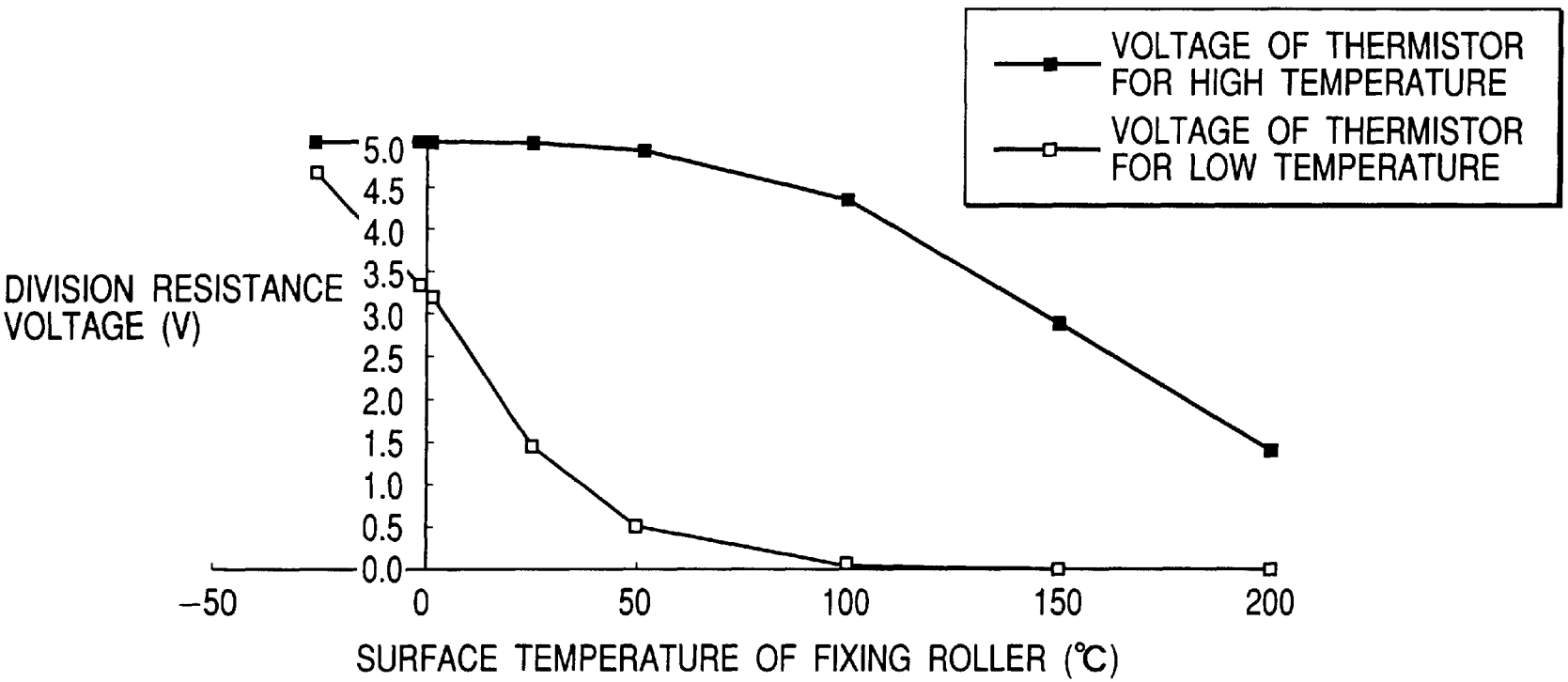
FIG. 3B is a graph showing a relation between temperatures measured by the thermistors for high and low temperatures and detected voltage in the same apparatus as FIG. 3A.
Figure 4:
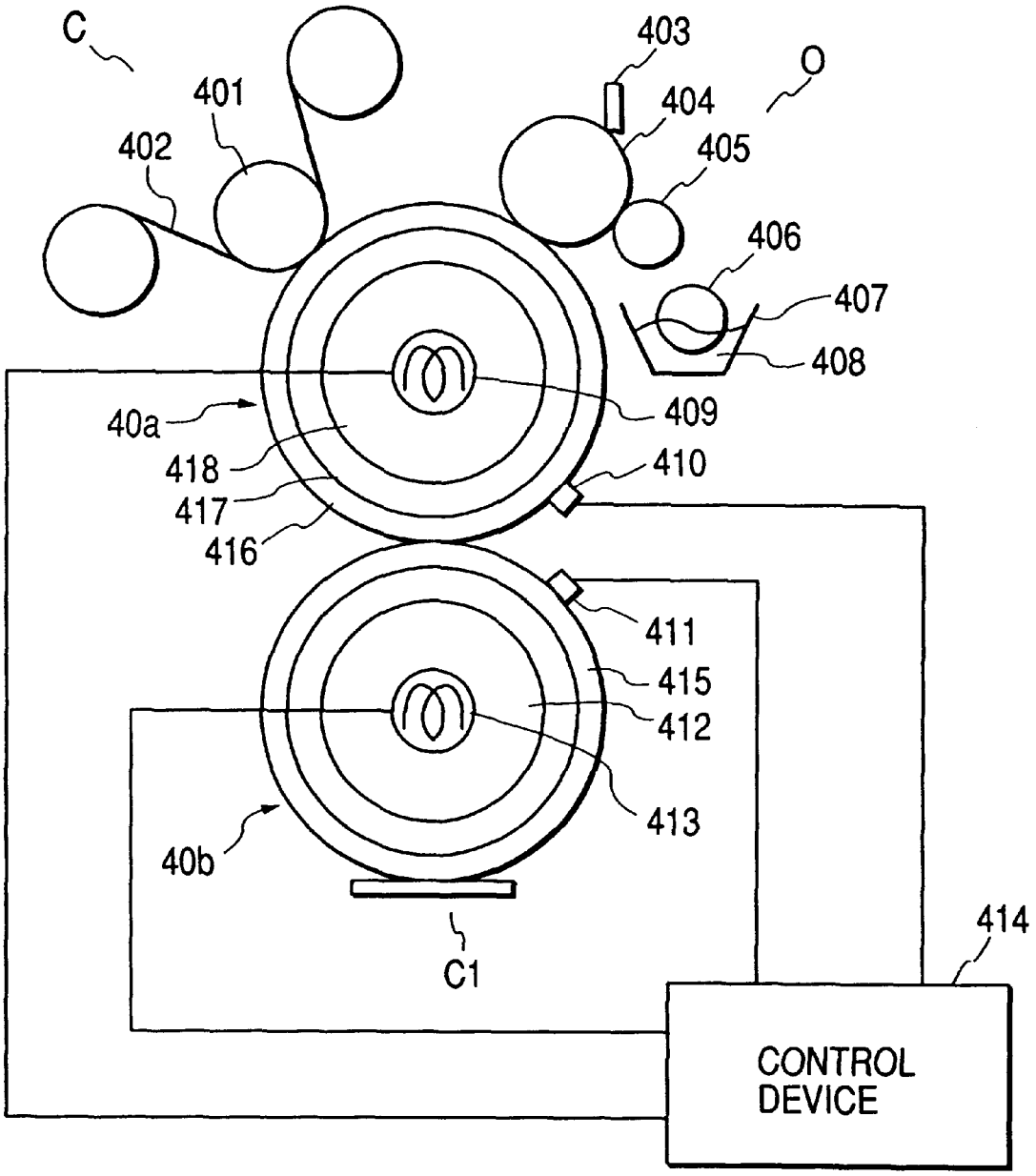
FIG. 4 PRIOR ART
FIG. 4 is a schematic view of a conventional fixing device.

FIG. 3B is a graph showing a relation between the temperatures measured by the thermistor for low temperature and the thermistor for high temperature, and the detected voltage. The graph indicates detected voltage property of the division voltage value of the thermistor for high temperature and detected voltage property of the division voltage value of the thermistor for low temperature within a temperature range of −50° C. to 200° C. when the resistance of 10 kΩ is used as the division resistance.

It can be seen from FIGS. 3A and 3B that the temperature can be measured with high accuracy within a wide range by using the combination of the thermistor for low temperature and the thermistor for high temperature, with the result that a low surface temperature of the roller (which could not measured correctly up to date) can be measured correctly, and, thus, even when the surface temperature of the roller is low, the abnormality such as poor attachment of the thermistor and/or breakage of a signal line of the thermistor.

<Explanation of Fixing Device>

Figure 6:
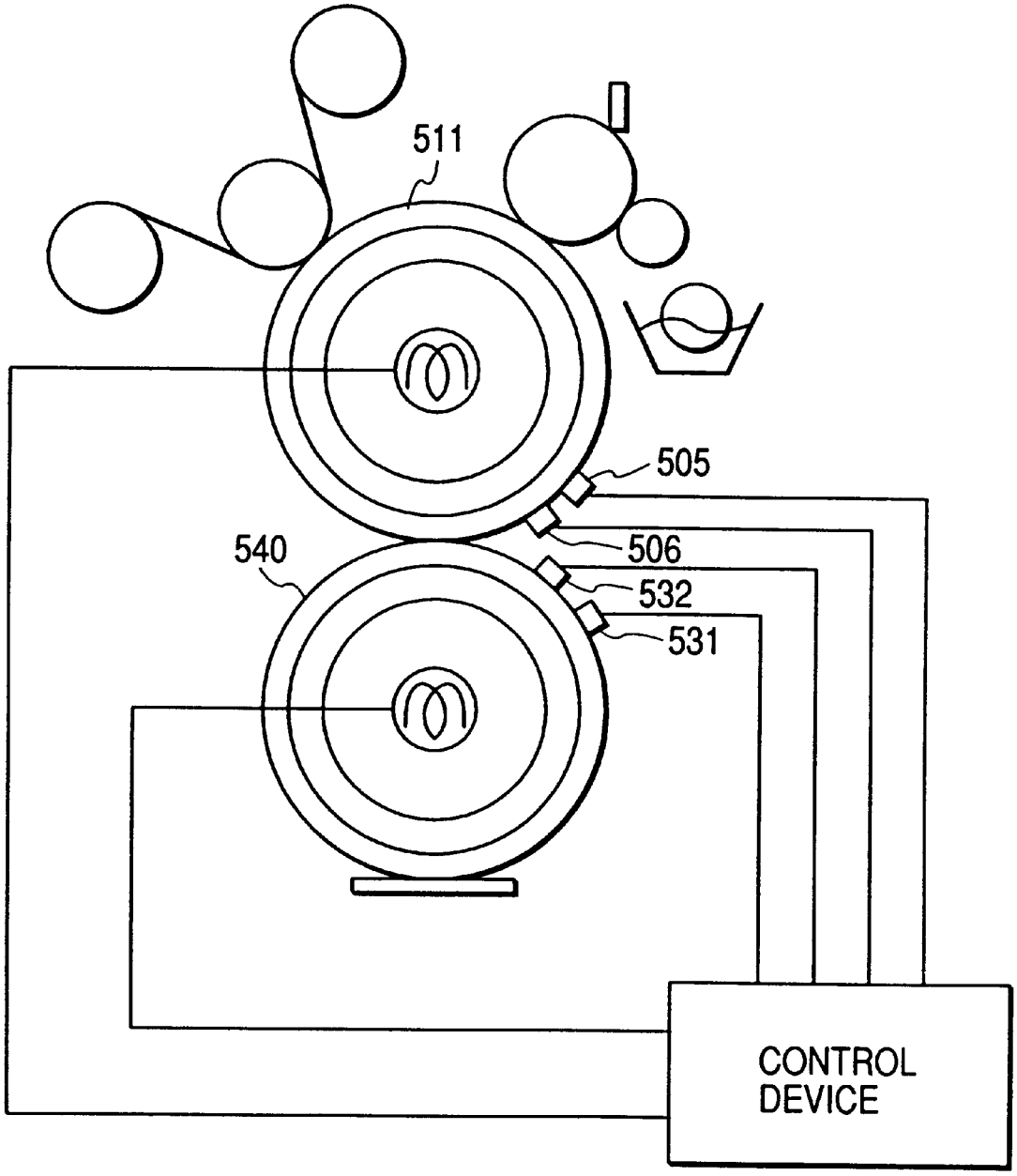
FIG. 6 is a schematic view of a fixing device of the heat fixing apparatus according to the first embodiment.

FIG. 6 schematically shows a fixing device according to the illustrated embodiment.

In the illustrated embodiment, a thermistor 505 for high temperature and a thermistor 506 for low temperature are contacted with a fixing roller 511, and a thermistor 531 for high temperature and a thermistor 532 for low temperature are contacted with a pressure roller 540. The thermistor 506 is disposed in the vicinity of the thermistor 505 and the thermistor 532 is disposed in the vicinity of the thermistor 531.

<Explanation of Control Circuit>

Figure 5:
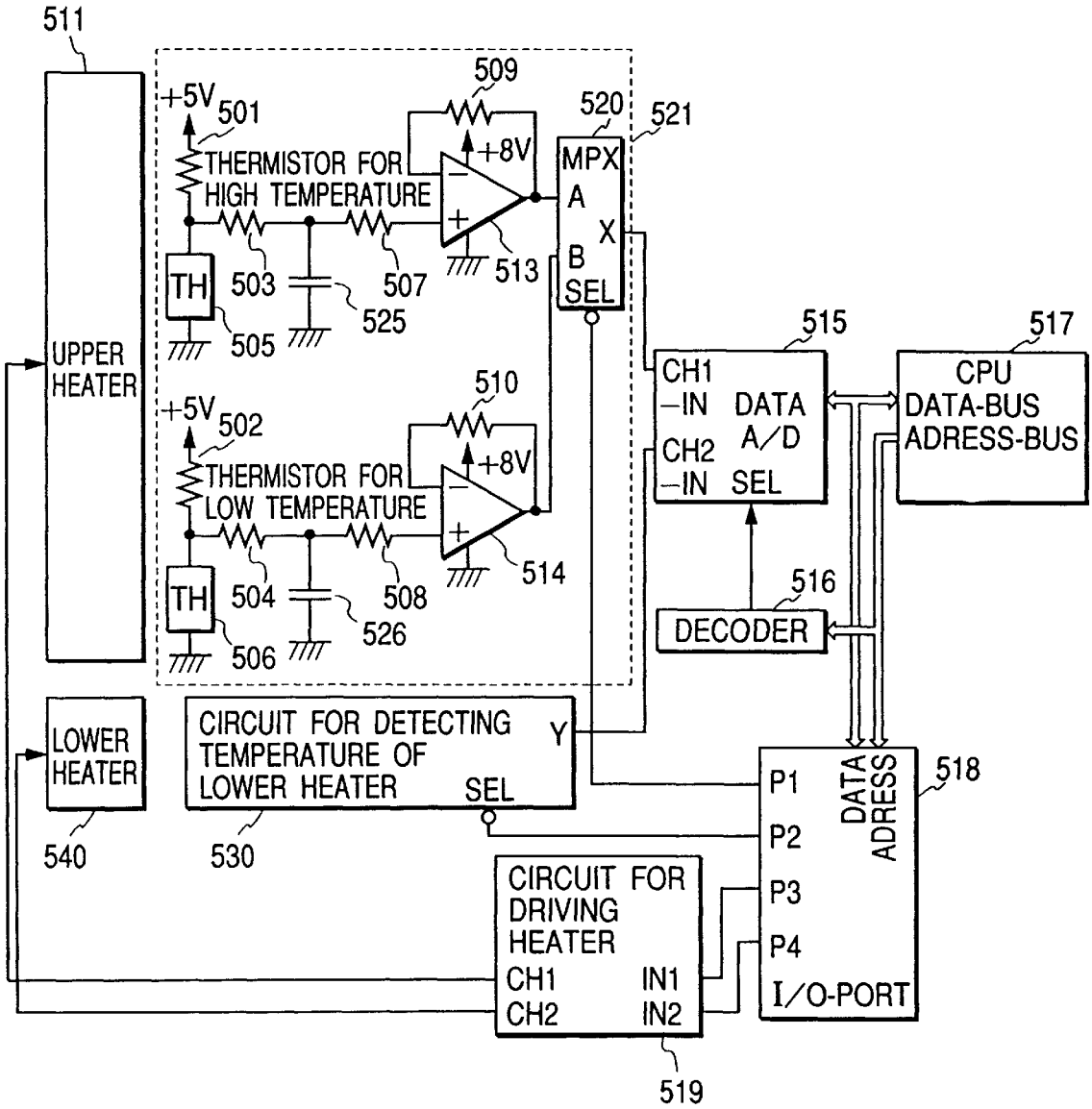
FIG. 5 is a circuit block diagram for measurement control in the heat fixing apparatus according to the first embodiment.

FIG. 5 shows a control circuit according to the illustrated embodiment.

In FIG. 5, the reference numerals 501, 503, 507, 508, 509 and 510 denote fixed resistances; 505 and 506 denote thermistors; 525 and 526 denote capacitors; 513 and 514 denote OP amplifiers; 520 denotes a multiplexer; 511 and 540 denote heat rollers; 515 denotes an A/D converter; 516 denotes a decoder; 517 denotes a CPU; 518 denotes an I/O port; and 519 denotes a heater drive circuit.

A lower heater temperature detecting circuit 530 has the same circuit arrangement as an upper heater temperature detecting circuit 521.

[Explanation of Upper Heater Control Circuit]

The surface temperature of the heat roller is read by the thermistor 505 contacted with the roller. The thermistor 505 has a variable resistance value varied with the temperature of the roller. The resistance value of the thermistor is great at a low temperature and is small at a high temperature. The power voltage (5V in the illustrated embodiment) is divided by the resistance value (corresponding to the temperature) of the thermistor 505 and the resistance value of the fixed resistance 501, thereby outputting division voltage corresponding to the surface temperature of the roller. The fixed resistance 503 and the capacitor 525 constitute a filter for removing a noise component included in the division voltage. The OP amplifier 513 acts as a buffer for effecting impedance conversion. An output of the OP amplifier 513 serves to supply division voltage corresponding to detected temperature of the thermistor for high temperature for the upper roller to an A channel of the multiplexer 520. The circuit for the thermistor for low temperature has the similar arrangement and serves supply division voltage corresponding to detected temperature of the thermistor for low temperature for the upper roller to a B channel of the multiplexer 520. The voltage values inputted to the A and B channels of the multiplexer 520 are outputted from the multiplexer in a time-sharing manner and are inputted to a channel 1 of the A/D converter 515. In the A/D converter 515, the inputted analog voltage is converted into a digital value. The detected temperature of the thermistor for high temperature for the upper roller and the detected temperature of the thermistor for low temperature for the upper roller which were converted into the digital values are sent to the CPU 517. The CPU 517 adjusts an amount of electric power to be applied to the upper heater 511 on the basis of the detected temperature of the thermistor for high temperature for the upper roller and the detected temperature of the thermistor for low temperature for the upper roller.

Figures 10, 10A:
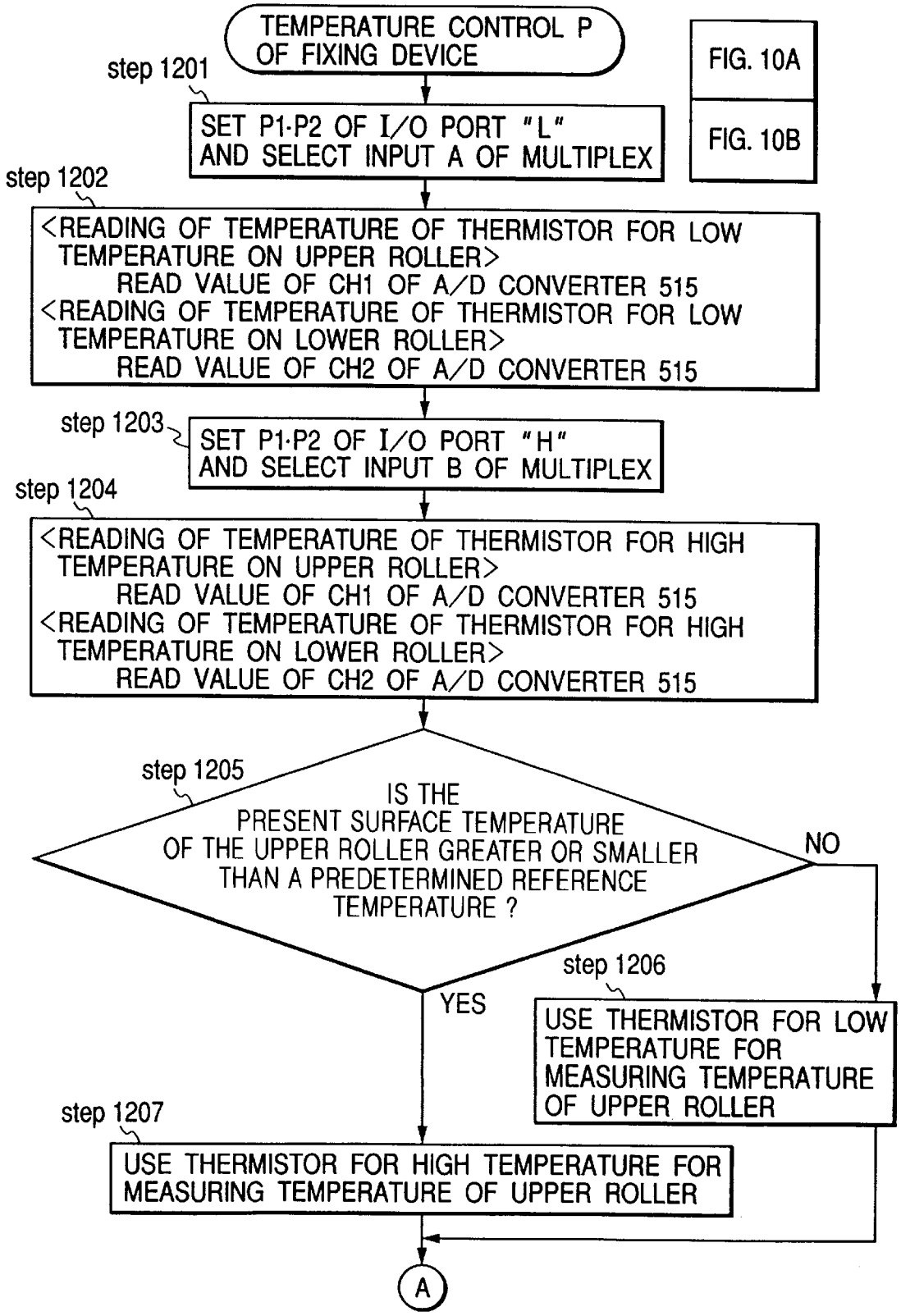
FIG. 10 which is comprised of FIGS. 10A and 10B is a flow chart for explaining an operation of a CPU of the heat fixing apparatus according to the first embodiment.
Figure 10B:
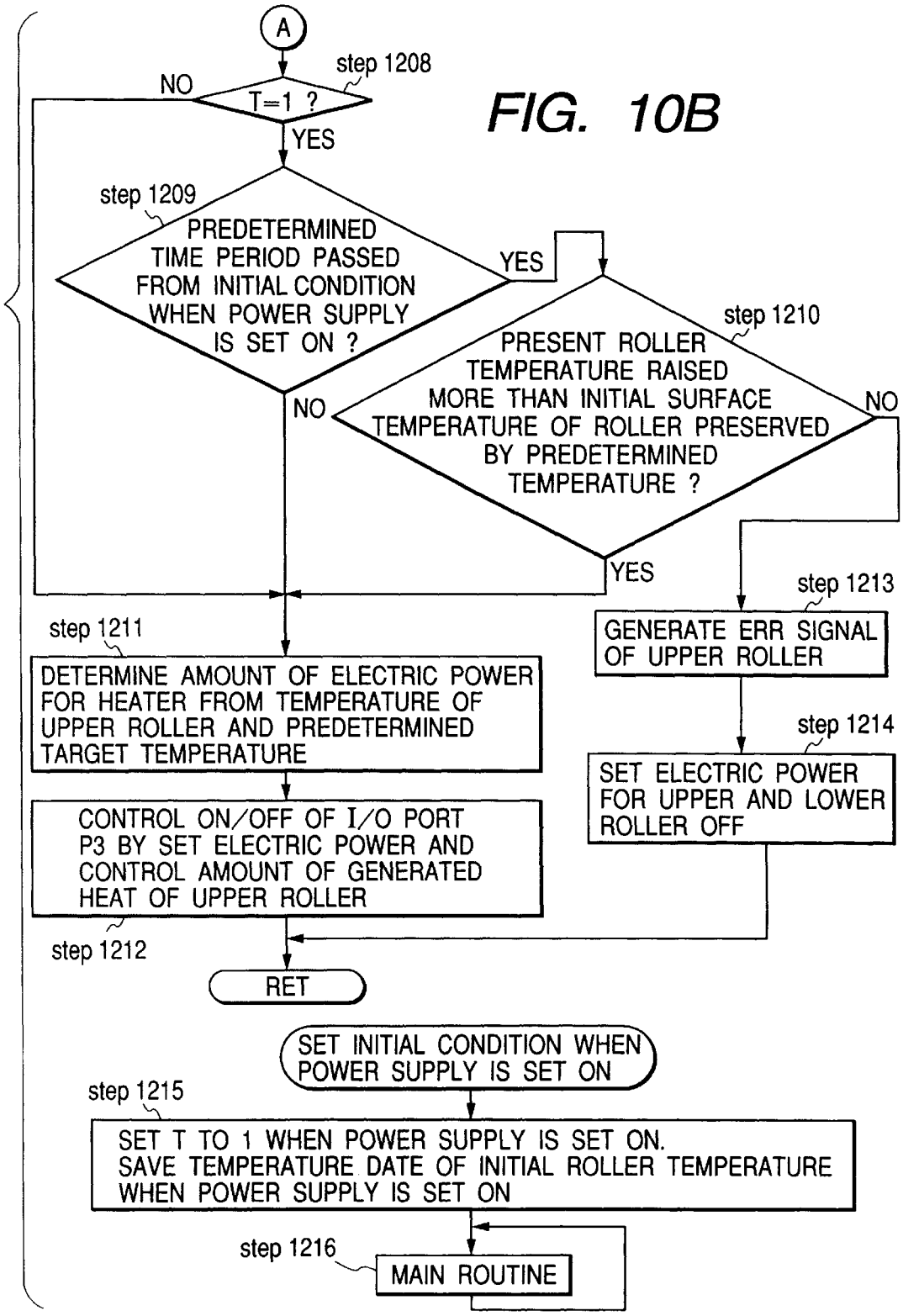

FIGS. 10A and 10B are flowchart showing an operation of the CPU 517.

When the fixing temperature control is started, initial setting is performed, the variable T which is a flag showing whether an abnormality of the thermistor is checked is changed to "1", an initial temperature of the roller when the power supply is set ON is measured and the temperature data is reserved. Thereafter, a main routine is carried out. In the main routine, a sub routine for adjusting the temperature of the fixing device is repeated at a predetermined interval.

In the subroutine for adjusting the temperature of the fixing device, temperature control of upper and lower heaters is performed. Here, although the flowchart regarding the temperature control of the upper heater will be explained, regarding the lower heater, the same treatment is carried out.

When the subroutine for adjusting the temperature of the fixing device is carried out, first of all, P1, P2 of the I/O port are set to "L" to select input A of the multiplex of the temperature adjusting circuits for the upper and lower heaters (step 1201). By selecting the input A of the multiplex of the temperature adjusting circuits for the upper and lower heaters, temperature voltages of the thermistors for high temperature for the upper and lower heaters are sent to the A/D converter. In the A/D converter, the temperature voltages (analog values) are converted into digital values. The temperatures (converted into the digital values) of the thermistors for high temperature for the upper and lower heaters is sent to the CPU (step 1202).

Then, P1, P2 of the I/O port are set to "H" to select input B of the multiplex of the temperature adjusting circuits for the upper and lower heaters (step 1203). By selecting the input B of the multiplex of the temperature adjusting circuits for the upper and lower heaters, temperature voltages of the thermistors for low temperature for the upper and lower heaters are sent to the A/D converter. In the A/D converter, the temperature voltages (analog values) are converted into digital values. The temperatures (converted into the digital values) of the thermistors for low temperature for the upper and lower heaters is sent to the CPU (step 1204).

On the basis of the temperatures of the thermistors for high and low temperatures for the upper and lower heaters sent to the CPU, it is judged whether the present surface temperature of the upper roller is greater or smaller than a predetermined reference temperature (for example, 70° C.) (step 1205). When a temperature range in which the linear property of the thermistor for low temperature is obtained is (−25° C. to 70° C.) and a temperature in which the linear property of the thermistor for high temperature is obtained is (70° C. to 250° C.) and the present temperature of the roller is equal to or smaller than 70° C., the temperature read by the thermistor for low temperature is used (step 1206), and, when the present temperature of the roller is equal to or larger than 70° C., the temperature read by the thermistor for high temperature is used (step 1207), with the result that the roller temperature reading can be effected with high accuracy within a wide temperature range of −25° C. to 250° C.

Then, it is judged whether or not the check for finding the abnormality such as poor attachment of the thermistors and/or breakage of a signal line of the thermistor is performed till now after the power supply is set ON (step 1208).

If the check has been performed (T=0), "heater electric power control" is effected and then the program is returned to the main routine.

If the check has not yet been performed (T=1), it is judged whether or not a predetermined time period is elapsed from an initial condition when the power supply is set ON (step 1209).

If the predetermined time period is not elapsed, the "heater electric power control" is effected and then the program is returned to the main routine.

On the other hand, if the predetermined time period is elapsed, the reserved initial surface temperature of the roller is compared with the present surface temperature of the roller and it is judged whether a difference in surface temperature is equal to or larger than a predetermined value or not (step 1210).

If the present temperature is increased beyond the initial temperature by the predetermined value, the "heater electric power control" is effected and then the program is returned to the main routine.

If the present temperature has not increased by the predetermined value, it is judged that there is an abnormality such as poor attachment of the thermistor and/or breakage of the signal line of the thermistor and an upper roller ERR signal is generated (step 1213), and the electric power applied to the upper and lower heaters is stopped (step 1214).

In this way, since two thermistors having different temperature properties are used, the accurate temperature detection can be achieved within a wide temperature range. Thus, even when the temperature of the fixing roller is low, the abnormality of the apparatus can be detected correctly.

<Heater Electric Power Control>

The electric power amount applied to the heater is determined so that the detected temperature of the thermistor maintains a target temperature in accordance with the temperature of the upper roller sent to the CPU (step 1211). ON/OFF control of the heater is performed on the basis of the determined electric power amount (step 1212).

(Second Embodiment)

Figure 11:
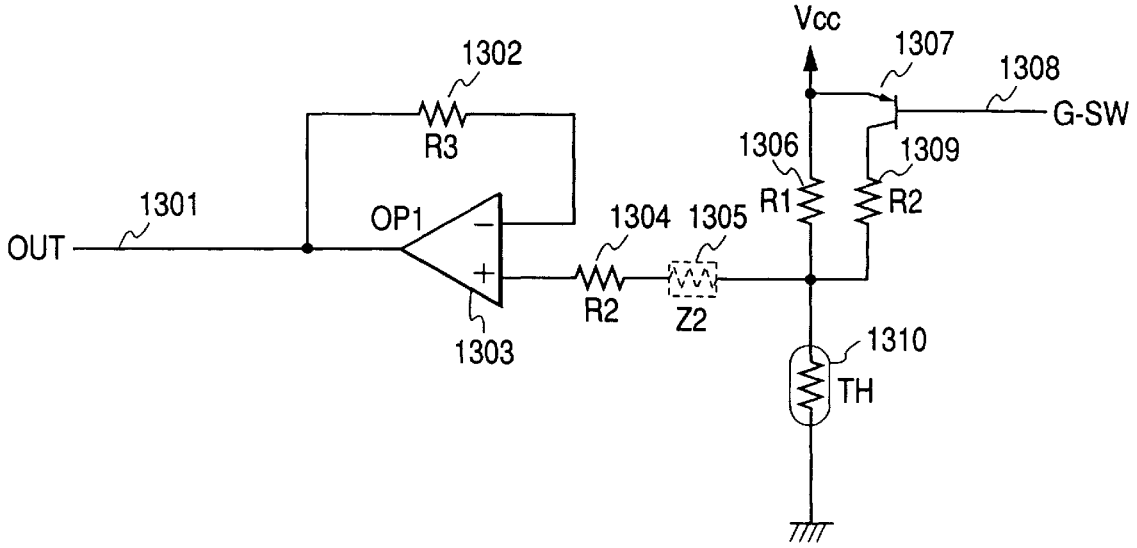
FIG. 11 is a circuit diagram for switching division resistance in a heat fixing apparatus according to a second embodiment of the present invention.

FIG. 11 shows a circuit including a thermistor of a heat fixing apparatus according to a second embodiment of the present invention.

In FIG. 11, the reference numerals 1302, 1304, 1306 and 1309 denote fixed resistances; 1303 denotes an OP amplifier; 1310 denotes a thermistor; 1307 denotes a transistor; 1305 denotes a circuit resistance component; 1301 denotes detected voltage corresponding to a temperature measured by the thermistor; and 1308 denotes a resolving power variable signal.

Regarding the detected voltage 1301, voltage obtained by dividing power source voltage (Vcc) by a resistance value $R_\alpha=(R_1)$ of the division resistance 1306 or resultant resistance of the division resistance 1306 and 1309, $\{(R_1\times R_2)/(R_1+R_2)\}$ and the resistance value ($R_{th}$) of the thermistor 1310 is outputted, and is represented by the following equation:

$$\text{Detected voltage } \mathbf{1301} \text{ (out)}=\{R_{th}/(R_\alpha+R_{th})\}\times Vcc$$

The transistor 1307 is used to switch the resistance value $R_\alpha$ to $R_1$ or $\{(R_1\times R_2)/(R_1+R_2)\}$.

For example, resistance of 100 MΩ is used as $R_1$ and resistance of 10 KΩ is used as $R_2$. In the low temperature area, by setting a control signal G-SW1308 of the transistor 1307 to "H", the resultant resistance value $R_\alpha$ of $R_1$ and $R_2$ becomes 100 MΩ, and division voltage value regarding the temperature becomes as shown in a Table 1402 in FIG. 12A and has a property curve 1422 shown in FIG. 12B.

Figure 12B:
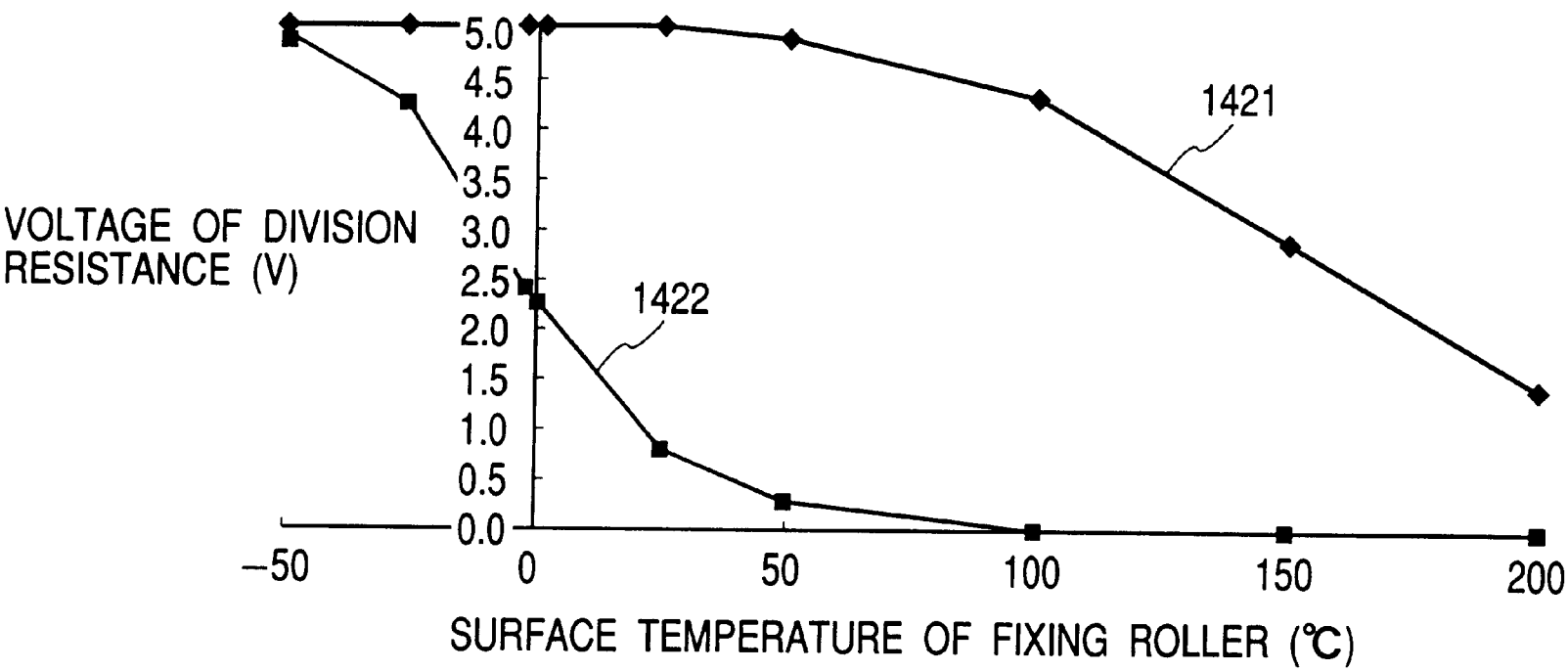
FIG. 12B is a graph showing property of the detected voltage in FIG. 12A.

In the high temperature area, by setting the control signal G-SW1308 of the transistor 1307 to "L", the resultant resistance value $R_\alpha$ of $R_1$ and $R_2$ becomes about 10 KΩ, and division voltage value regarding the temperature becomes as shown in a Table 1401 in FIG. 12A and has a property curve 1421 shown in FIG. 12B.

In the first embodiment, while the temperature detecting range was widened by using two thermistors for high and low temperatures, in the second embodiment, the temperature detecting range is widened by using two fixed resistances having different resistance values.

When a plurality of fixed resistances having different resistance values are provided, it is ideal that thermistors capable of measuring a sufficient wide range of temperatures as the temperature detecting means, and for example, when a thermistor capable of measuring a temperature range of −25° C. to 250° C. is used, high resolving power can be obtained within a temperature range sufficient to achieve the object of the present invention.

As mentioned above, by using the combination of higher resolving powers of the detected voltage (regarding the measured temperatures) of two temperature detecting properties, it is possible to provide a temperature detecting apparatus for the fixing apparatus capable of detecting the temperature with high accuracy within a wide temperature range.

(Third Embodiment)

In a heat fixing apparatus according to a third embodiment of the present invention, in addition to the thermistors contacted with the fixing roller and the pressure roller, there is an arrangement in which an abnormality of the thermistor contacted with the fixing roller can be detected by measuring an environmental temperature of the surface of the fixing roller in a non-contact (with the fixing roller) manner.

<Explanation of Fixing Device>

Figure 7:
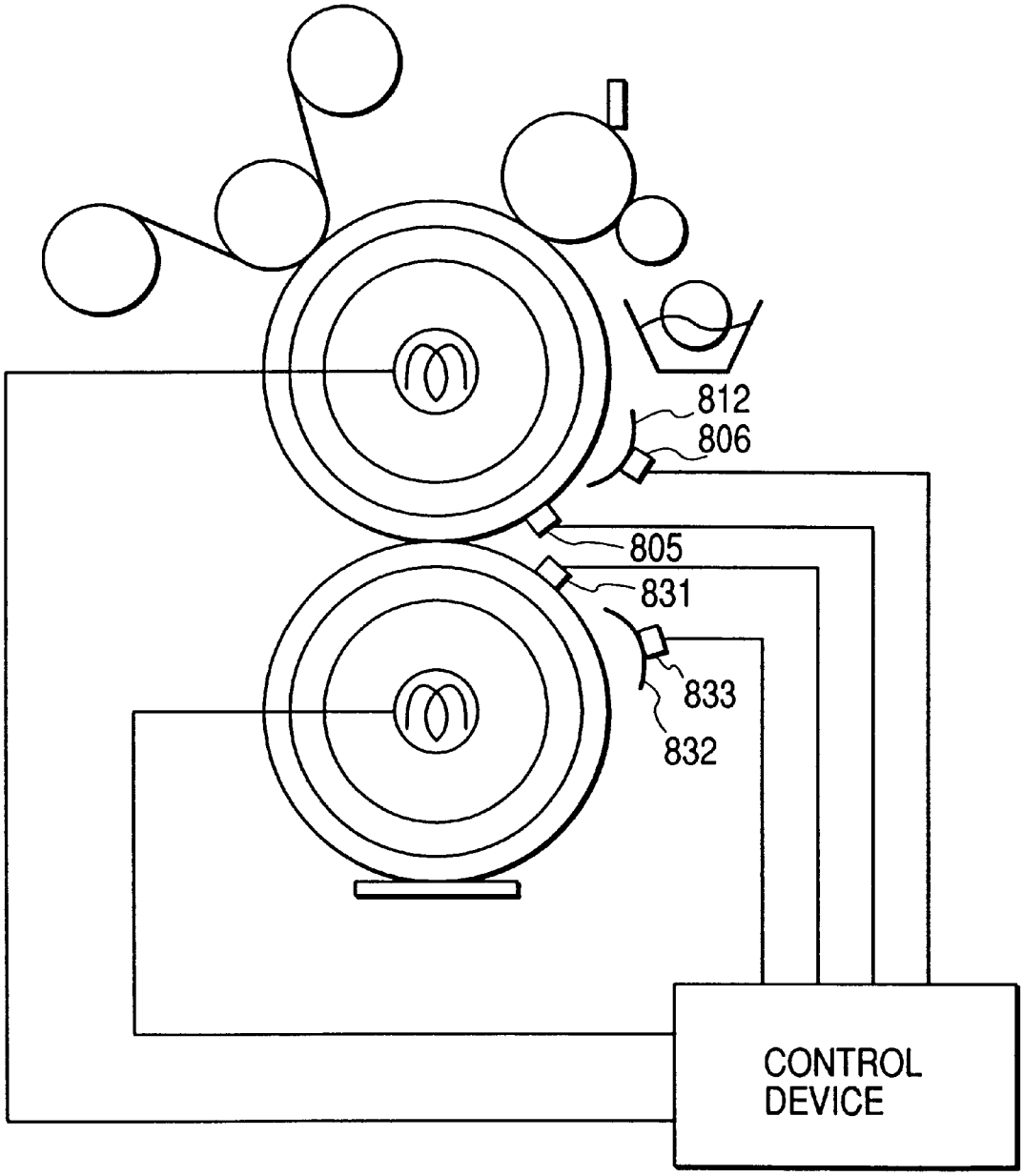
FIG. 7 is a schematic view of a fixing device of a heat fixing apparatus according to a third embodiment of the present invention.

FIG. 7 is a constructural view of a fixing apparatus according to a third embodiment of the present invention.

Roller environmental temperature measuring plates 812, 832 formed from metallic plates having good heat conductivity such as iron are disposed in the vicinity of the fixing rollers in a fixed relation with respect to movable parts, i.e., rollers. Thermistors 806, 833 are contacted with the roller environmental temperature measuring plates so that the temperature measurement can be effected.

<Explanation of Control Circuit>

Figure 8:
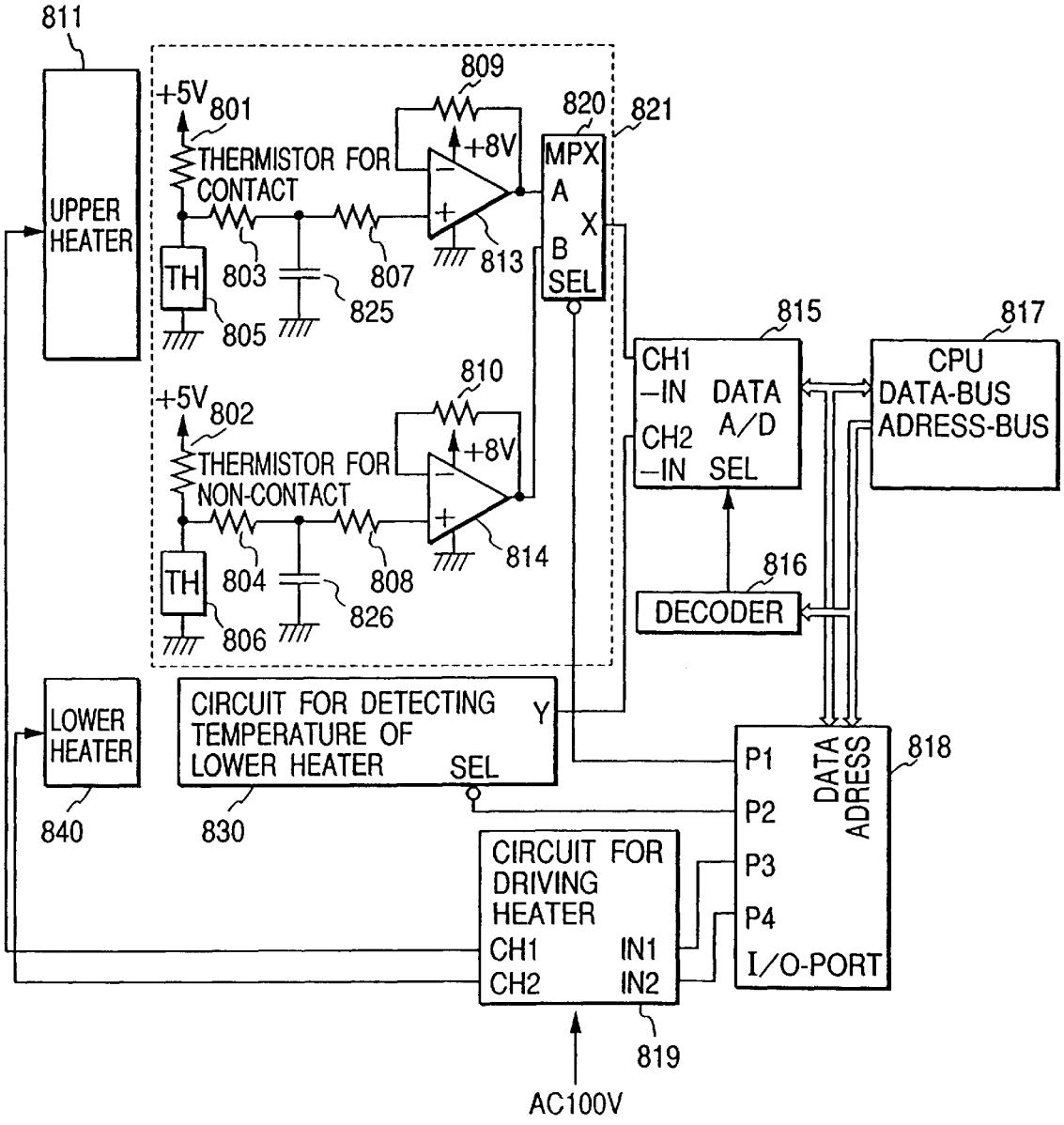
FIG. 8 is a circuit block diagram for measurement control in the heat fixing apparatus according to the third embodiment.

FIG. 8 shows a control circuit according to the illustrated embodiment.

In FIG. 8, the reference numerals 801, 803, 807, 808, 809 and 810 denote fixed resistance; 805 and 806 denote thermistors detecting the surface temperature of the fixing roller; 825 and 826 denote capacitors; 813 and 814 denote OP amplifiers; 820 denotes a multiplexer; 811 and 840 denote heat rollers; 831 denotes a thermistor detecting the surface temperature of the pressing roller; 815 denotes an A/D converter; 816 denotes a decoder; 817 denotes a CPU; 818 denotes an I/O port; and 819 denotes a heater drive circuit.

A lower heater temperature detecting circuit 830 has the same circuit arrangement as an upper heater temperature detecting circuit 821.

[Explanation of Heater Control Circuit]

The surface temperature of the heat roller is read by the thermistor 805 contacted with the roller. The thermistor 805 has a variable resistance value varied with the temperature of the roller. The resistance value of the thermistor is high at a low temperature and is low at a high temperature. The power voltage 5V is divided by the resistance value (corresponding to the temperature) of the thermistor 805 and the resistance value of the fixed resistance 801, thereby outputting division voltage corresponding to the surface temperature of the roller. The fixed resistance 803 and the capacitor 825 constitute a filter for removing a noise component included in the division voltage. The OP amplifier 813 acts as a buffer for effecting impedance conversion. An output of the OP amplifier 813 serves to supply division voltage corresponding to the surface temperature of the upper roller to an A channel of the multiplexer 820. The thermistor 806 of non contact type has the similar arrangement and serves supply division voltage corresponding to the temperature of the non contact metallic plate 812 to a B channel of the multiplexer 820. The upper roller surface temperature voltage and the upper roller environmental temperature voltage inputted to the multiplexer 820 are outputted from the multiplexer in a time-sharing manner and are inputted to a channel 1 of the A/D converter 815. In the A/D converter 815, the inputted analog voltage is converted into a digital value. The upper roller surface temperature and the upper roller environmental temperature which were converted into the digital values are sent to the CPU 817. The CPU 817 adjusts an amount of electric power to be applied to the upper heater 811 on the basis of the upper roller surface temperature and the upper roller environmental temperature.

Figures 9, 9A:
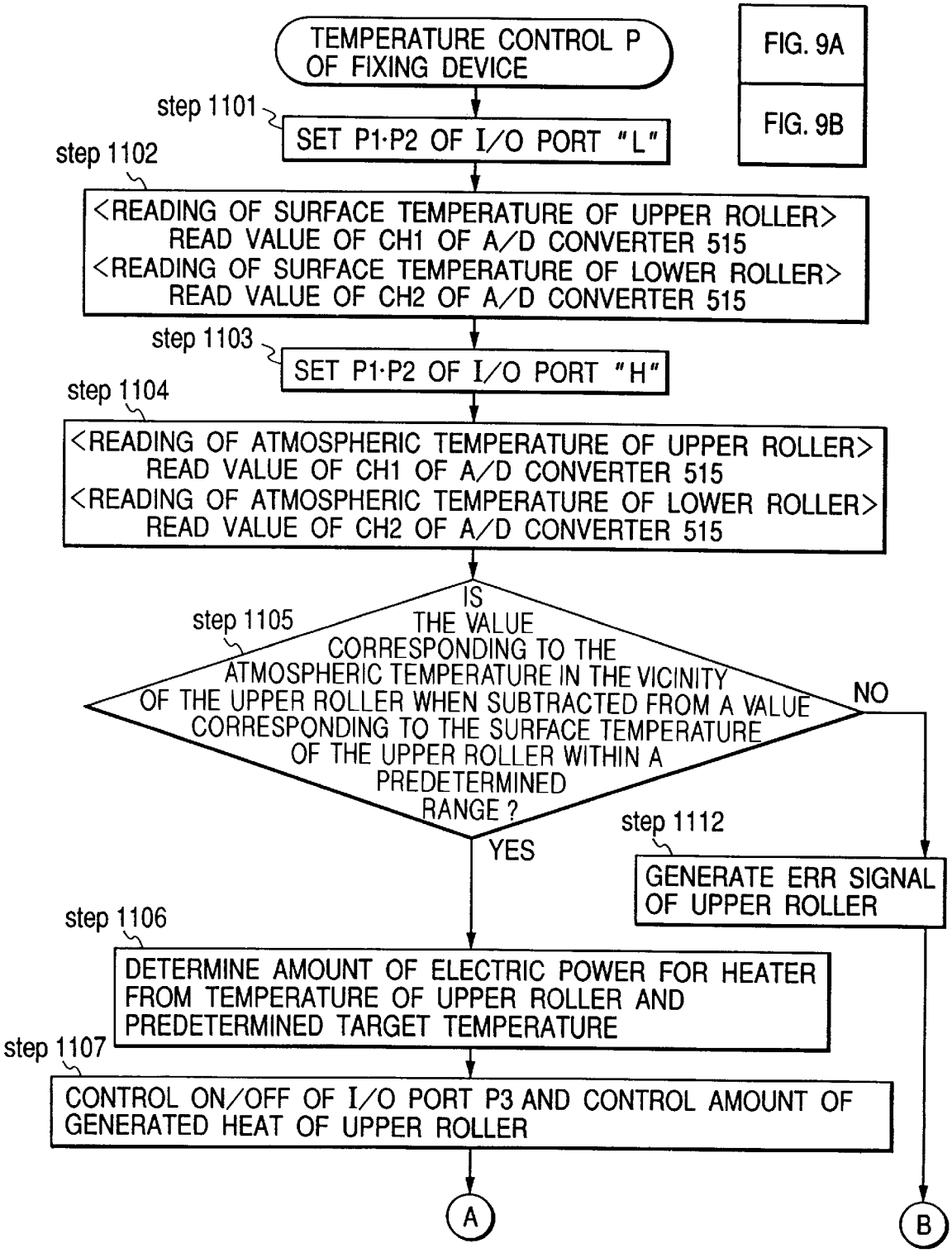
FIG. 9 which is comprised of FIGS. 9A and 9B is a flow chart for explaining an operation of a CPU of the heat fixing apparatus according to the third embodiment.
Figure 9B:
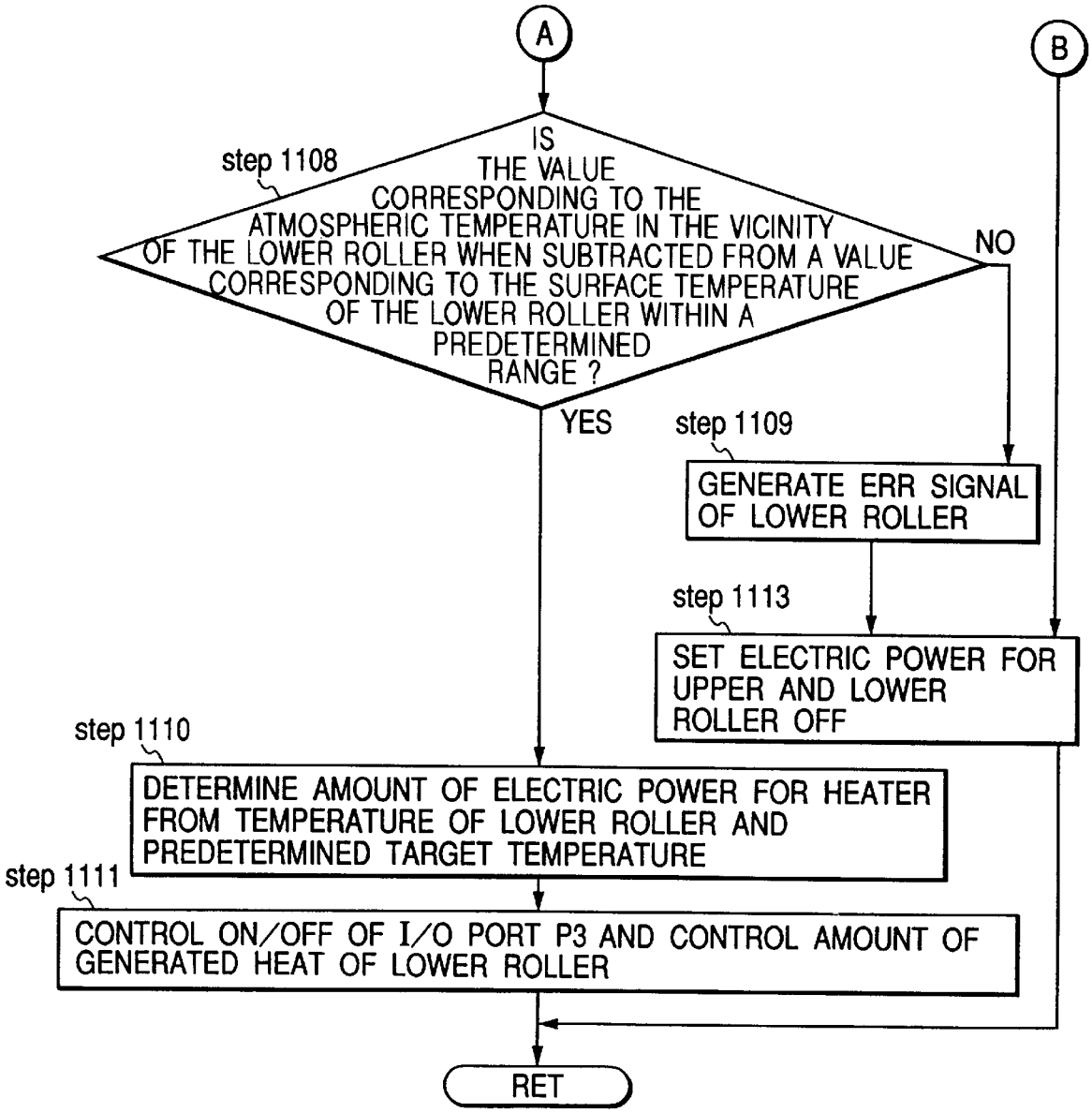

FIGS. 9A and 9B are flowcharts showing an operation of the CPU 817.

When the fixing temperature control is started, P1, P2 of the I/O port are set to "L" to convert the voltage corresponding to the roller surface temperature into a digital value by the A/D converter (step 1101). Data regarding the surface temperatures of the upper and lower rollers are read out from the A/D converter (step 1102). Then, P1, P2 of the I/O port are set to "H" to convert the voltage corresponding to the roller environmental temperature into a digital value by the A/D converter (step 1103). Data regarding the environmental temperatures of the upper and lower rollers are read out from the A/D converter (step 1104).

Then, it is judged whether the roller environmental temperature data is included within a predetermined range with respect to the upper roller surface temperature data (step 1105). This is done because, if the roller surface temperature data is considerably different from the upper and lower roller environmental temperature data, there is a danger of an abnormality recurring such as, poor contact between the rollers and the thermistors/and or breakage of the signal line of the thermistor.

If the upper roller environmental temperature data is not included within a predetermined range with respect to the upper roller surface temperature data, an upper roller ERR signal is generated (step 1112). When the upper roller ERR signal is generated, the electric power applied to the upper heater is stopped (step 1113).

If the upper roller environmental temperature data is included within a predetermined range with respect to the upper roller surface temperature data, the electric power amount to be applied to the heater is determined on the basis of the upper roller temperature and the predetermined target temperature (step 1106). The heater drive circuit is ON/OFF-controlled via the I/O port in accordance with the determined electric power amount (step 1107).

Thereafter, it is judged whether the lower roller environmental temperature data is included within a predetermined range with respect to the lower roller surface temperature data (step 1108).

If the lower roller environmental temperature data is not included within a predetermined range with respect to the lower roller surface temperature data, a lower roller ERR signal is generated (step 1109). When the lower roller ERR signal is generated, the electric power applied to the lower heater is stopped (step 1113).

If the lower roller environmental temperature data is included within a predetermined range with respect to the lower roller surface temperature data, the electric power amount to be applied to the heater is determined on the basis of the lower roller temperature and the predetermined target temperature (step 1110). The heater drive circuit is ON/OFF-controlled via the I/O port in accordance with the determined electric power amount (step 1111).

The above-mentioned operation is repeated at a predetermined interval, thereby keeping the surface temperatures of the upper and lower rollers of the fixing device constant.

What is claimed is:

1. An image heating apparatus comprising:

a heating member for heating an image on a recording material;

a first temperature detecting element for detecting a temperature of said heating member;

a second temperature detecting element for detecting the temperature of said heating member, a thermal property of said second temperature detecting element differing from a thermal property of said first temperature detecting element; and a power supply control means for controlling an electrical power supplied to said heating member by utilizing said first temperature detecting element and said second temperature detecting element;

wherein, when the temperature of said heating member is lower than a predetermined reference temperature, said power supply control means controls the electrical power in accordance with the temperature detected by said first temperature detecting element, and when the temperature of said heating member is not less than the reference temperature, said power supply control means controls the electrical power is accordance with the temperature detected by said second temperature detecting element.

2. An image heating apparatus comprising:

a heating member for heating an image on a recording material;

a first temperature detecting element for detecting a temperature of said heating member;

a second temperature detecting element for detecting the temperature of said heating member, a thermal property of said second temperature detecting element differing from a thermal property of said first temperature detecting element;

a power supply control means for controlling an electrical power supplied to said heating member by utilizing said first temperature detecting element and said second temperature detecting element;

an abnormality detecting means for detecting an abnormality of said apparatus; and wherein said abnormality detecting means judges that said apparatus is abnormal if, while the electrical power is supplied to the heating member, a rate of temperature change of said heating member is smaller than a predetermined rate.

3. An image heating apparatus, comprising:

a heating member for heating an image on a recording material;

a temperature detecting element for detecting a temperature of said heating member;

power supply control means for controlling an electrical power supplied to said heating member in accordance with the temperature detected by said temperature detecting element;

plural resistances connected to said temperature detecting element;

resistance value switching means for switching a resultant resistance value of said plural resistances in accordance with the temperature of said heating member.

4. An image heating apparatus according to claim 3, wherein said resistance value switching means sets the resultant resistance value high when the temperature of said heating member is low and sets the resultant resistance value low when the temperature of said heating member is high.

* * * * *

UNITED STATES PATENT AND TRADEMARK OFFICE

CERTIFICATE OF CORRECTION

PATENT NO. : 6,173,131 B1
DATED : January 9, 2001
INVENTOR(S) : Shingo Kitamura, et al.

It is certified that error appears in the above-identified patent and that said Letters Patent is hereby corrected as shown below:

Title page,
Item [56], "Ny" should read -- Nye --.

Column 8,
Line 29, "flowchart" should read -- flowcharts --.

Column 11,
Line 7, "813" should read -- 831 --.

Column 12,
Line 65, "is" should read -- in --.

Signed and Sealed this

Thirtieth Day of October, 2001

*Attest:*

Nicholas P. Godici

NICHOLAS P. GODICI
*Acting Director of the United States Patent and Trademark Office*

*Attesting Officer*